US011839859B2

(12) United States Patent
Bielozer

(10) Patent No.: US 11,839,859 B2
(45) Date of Patent: Dec. 12, 2023

(54) AGITATOR IMPELLER

(71) Applicant: Woodman Agitator, Avon, OH (US)

(72) Inventor: Keith Bielozer, Avon, OH (US)

(73) Assignee: Woodman Agitator, Avon, OH (US)

( * ) Notice: Subject to any disclaimer, the term of this patent is extended or adjusted under 35 U.S.C. 154(b) by 222 days.

(21) Appl. No.: 16/168,946

(22) Filed: Oct. 24, 2018

(65) Prior Publication Data

US 2019/0126218 A1 May 2, 2019

Related U.S. Application Data

(60) Provisional application No. 62/578,757, filed on Oct. 30, 2017.

(51) Int. Cl.

| | |
|---|---|
| ***B01F 27/113*** | (2022.01) |
| ***B01F 27/88*** | (2022.01) |
| ***B01F 27/053*** | (2022.01) |
| ***B01F 27/07*** | (2022.01) |
| ***B01F 27/91*** | (2022.01) |
| ***B01F 27/213*** | (2022.01) |
| ***B01F 35/32*** | (2022.01) |
| *B01F 101/30* | (2022.01) |

(52) U.S. Cl.

CPC ..... *B01F 27/88* (2022.01); *B01F 27/053* (2022.01); *B01F 27/071* (2022.01); *B01F 27/113* (2022.01); *B01F 27/213* (2022.01); *B01F 27/91* (2022.01); *B01F 35/323* (2022.01); *B01F 35/3204* (2022.01); *B01F 35/3214* (2022.01); *B01F 2101/30* (2022.01)

(58) Field of Classification Search

CPC ..... B01F 15/00448; B01F 15/00538; B01F 2015/00603; B01F 2215/005; B01F 7/00033; B01F 7/001; B01F 7/00341; B01F 7/00725; B01F 7/1695; B01F 7/22; B01F 2101/30; B01F 27/053; B01F 27/071; B01F 27/113; B01F 27/213; B01F 27/88; B01F 27/91; B01F 35/3204; B01F 35/3214; B01F 35/323

USPC ..... 416/234

See application file for complete search history.

(56) References Cited

U.S. PATENT DOCUMENTS 2,671,408 A * 3/1954 Kreitchman ..... F04D 29/106 277/386
2,882,077 A * 4/1959 Marsh ..... B29C 65/565 416/241 R
3,041,052 A * 6/1962 Dedoes ..... B01F 7/1695 366/247

(Continued)

*Primary Examiner* — David L Sorkin
(74) *Attorney, Agent, or Firm* — Renner, Otto, Boisselle & Sklar, LLP

(57) ABSTRACT

An agitator for being disposed in a container and rotated to agitate fluid in the container includes a shaft and an impeller attached thereto. The shaft, being supported relative to the container, provides an input for attachment of a rotation mechanism for causing rotation of the impeller and shaft. The impeller includes an impeller body defined by a hub portion for receiving and being mounted to the shaft, and a plurality of blades extending radially outwardly from a longitudinal axis of the hub portion. The impeller body is a single piece of unitary construction, such as where the plurality of blades are formed in a manner that the blades are integral with the hub portion at the formation of the blades.

19 Claims, 6 Drawing Sheets

(56) References Cited

U.S. PATENT DOCUMENTS

| | | | | | |
|---|---|---|---|---|---|
| 3,175,808 | A * | 3/1965 | Dedoes | B01F 7/1675 | 366/280 |
| 3,330,539 | A * | 7/1967 | Lurski | A47J 43/0711 | 416/76 |
| 4,628,574 | A * | 12/1986 | Lerman | B01F 7/001 | 29/467 |
| 5,588,803 | A * | 12/1996 | Vetter | F04D 29/282 | 29/453 |
| 5,727,878 | A * | 3/1998 | Sullivan, Jr. | B01F 13/002 | 220/495.01 |
| 6,419,385 | B1 * | 7/2002 | Walls | B01F 7/1695 | 366/247 |
| 7,318,668 | B2 * | 1/2008 | Bielozer | B01F 7/1695 | 366/331 |
| 2004/0145966 | A1 * | 7/2004 | Kar | B01F 27/1123 | 366/329.1 |
| 2005/0239199 | A1 * | 10/2005 | Kunas | C12M 23/14 | 435/297.1 |
| 2010/0149904 | A1 * | 6/2010 | Ohi | B01F 27/805 | 366/249 |
| 2012/0008455 | A1 * | 1/2012 | Sand | B01F 7/1695 | 366/130 |
| 2017/0232408 | A1 * | 8/2017 | Jobling | B01F 7/00041 | 366/64 |

* cited by examiner

AGITATOR IMPELLER

FIELD OF INVENTION

The present invention relates generally to an agitator for agitating liquids and liquid suspensions, and more particularly to an agitator having a unitary impeller, with the agitator being incorporated into a container for agitating liquids or liquid suspensions in the container.

BACKGROUND

Large quantities of fluids, such as paints and other liquid mixtures, are often stored in large containers having a cylindrical side wall and circular head and bottom walls. Such a container is commonly called a drum, with the walls commonly being formed from sheet metal such as steel. One typical size is a 50-gallon drum.

Liquids and liquid suspensions stored in such containers are often agitated using a bladed agitating device. The bladed agitating device, called an agitator, can be mounted relative to the container, such as to one or both of the circular head wall and the circular bottom wall. The mounting supports the agitator during rotation thereof to agitate the fluid therein. The agitator can be controlled by a powered or unpowered motive device that is configured for causing movement, such as rotation, of the agitating device.

SUMMARY OF INVENTION

The present invention provides an agitator for being disposed in a container and rotated to agitate fluid in the container. The agitator includes a shaft and an impeller attached thereto. The shaft, being supported relative to the container, provides an input for attachment of a rotation mechanism for causing rotation of the impeller and shaft. The impeller includes an impeller body defined by a hub portion for receiving and being mounted to the shaft, and a plurality of blades extending radially outwardly from a longitudinal axis of the hub portion. The impeller body is a single piece of unitary construction, such as where the plurality of blades are formed in a manner that the blades are integral with the hub portion at the formation of the blades.

An exemplary agitator for being disposed in a container and rotated to agitate a fluid in the container includes a shaft for being supported relative to the container, and an impeller having an impeller body comprising a hub portion for receiving and being mounted to the shaft, and a plurality of blades extending radially outwardly from a longitudinal axis of the hub portion, wherein the impeller body comprises a single molded article having unitary construction.

The hub portion may include an axially extending bottom recess for receiving a support post of a bottom wall of the container.

The plurality of blades may include a pair of opposed blades extending outwardly from the longitudinal axis of the central hub in opposite directions.

Each of the blades may extend along a lateral blade axis outwardly from the hub portion to a distal end, and each of the blades may include a transversely-extending rib at the respective distal end extending in a direction transverse the lateral blade axis.

Each of the blades may include an upper longitudinal edge opposite a lower longitudinal edge, and a laterally-extending rib may extend along the upper longitudinal edge.

The plurality of blades may extend from the hub portion absent the need for welds or fasteners.

The impeller body being a single piece of unitary construction may be a body formed as a single piece without the need for subsequent attachment of the plurality of blades to the hub portion.

The body may be composed of a synthetic polymer.

The synthetic polymer may include nylon.

The agitator may be sized for being disposed in a container having an internal volume in the range of 10 gallons to 100 gallons.

The agitator may be sized for being disposed in a container having an internal volume in the range of 30 gallons to 60 gallons.

The plurality of blades of the impeller body may be formed in a manner that the blades are integral with the hub portion at the formation of the blades.

The agitator may be in combination with a container, the impeller body being disposed in the container at a lower portion thereof and the shaft being supported along a central longitudinal axis of the container.

An exemplary container assembly for containing and agitating a fluid includes a cylindrical container and an agitator disposed in the container for agitating fluid in the container, wherein the agitator includes a shaft and an impeller connected thereto, wherein the impeller is a single molded article having unitary construction, wherein the single piece impeller includes a centrally-located hub portion and at least a pair of blades projecting from the hub portion, and wherein the container includes a top wall having a central opening for allowing access to the shaft for providing rotation of the agitator within the container.

The container may be a cylindrical drum having an internal volume in the range of 30 gallons to 60 gallons.

The blades of the pair of blades may project from the hub portion absent the need for welds or fasteners in contact with the pair of blades.

Each blade of the pair of blades may include ribs projecting outwardly from a main blade body and extending along the main blade body in at least two directions transverse one another.

An exemplary method of forming an agitator for agitating a liquid in a container comprises the steps of (a) forming a single article impeller having unitary construction and including a central hub portion and two or more blades extending therefrom, wherein the plurality of blades of the impeller are formed in a manner that the blades are integral with the hub portion at the formation of the blades, (b) inserting a shaft into an upper receiving cavity of the central hub portion, and (c) connecting the shaft to the impeller such that the shaft is precluded from axial removal from the impeller.

The forming a single article impeller may be completed absent the need for a secondary operation to attach the blades to the hub portion.

The forming a single article impeller may include injection molding the impeller.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

BRIEF DESCRIPTION OF THE DRAWINGS

The annexed drawings, which are not necessarily to scale, show various aspects of the disclosure.

DETAILED DESCRIPTION

The principles of the present disclosure have general application to an agitator for agitating fluids, such as liquids and liquid suspensions, and more particular application to an agitator having a unitary or single-piece impeller that is provided for agitating a liquid surface coating in a large container, such as a drum. Such an agitator may be suitable for the agitation of stains or thixotropic liquid surface coatings such as paints or floor coatings, for example. The agitator also may be suitable for agitation of waste products, cement, two-part suspensions requiring agitation for activation, etc.

Figure 1:
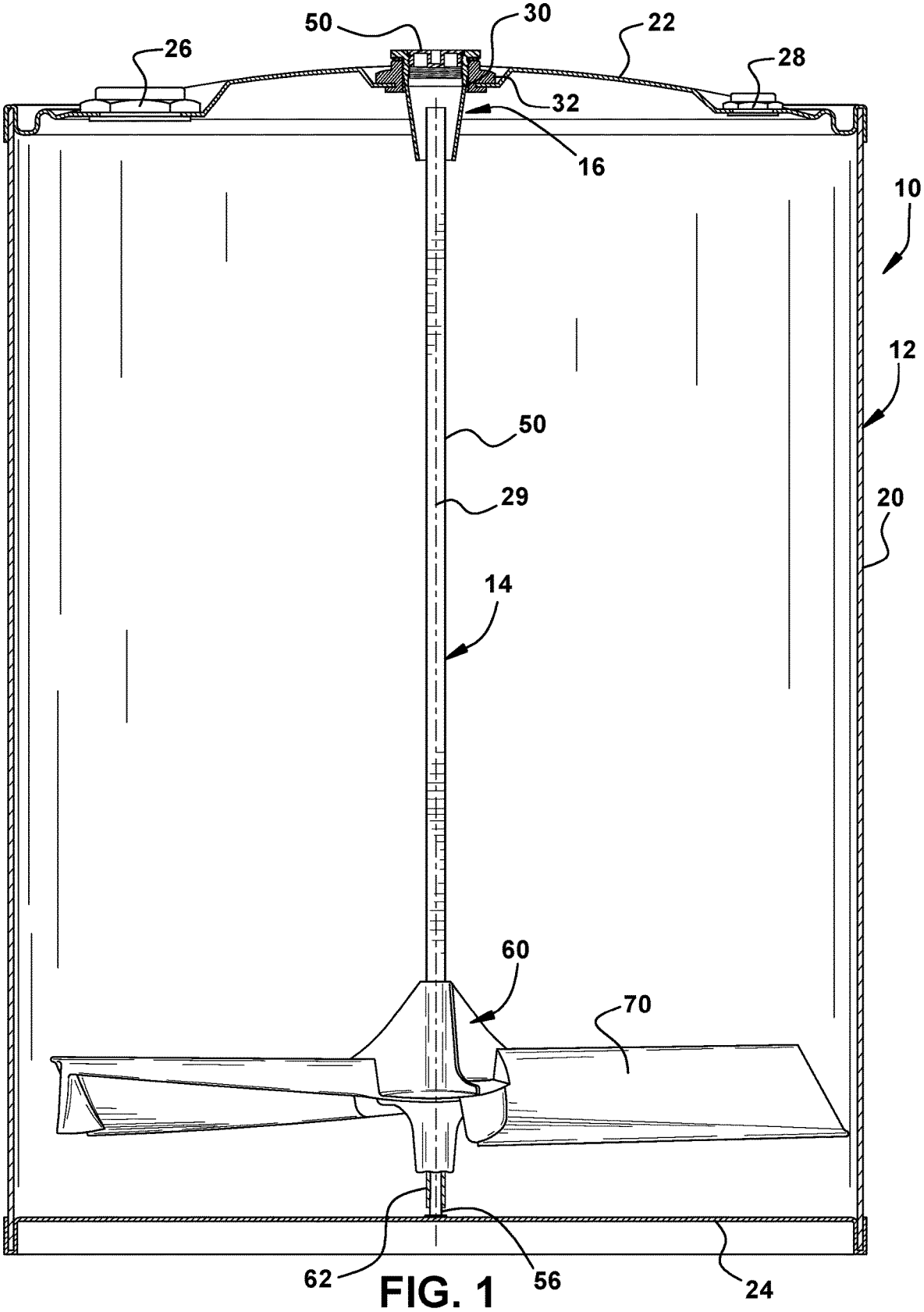
FIG. 1 is a side view partly in cross-section of a container assembly including a container and an agitator in accordance with the present invention.
Figure 2:
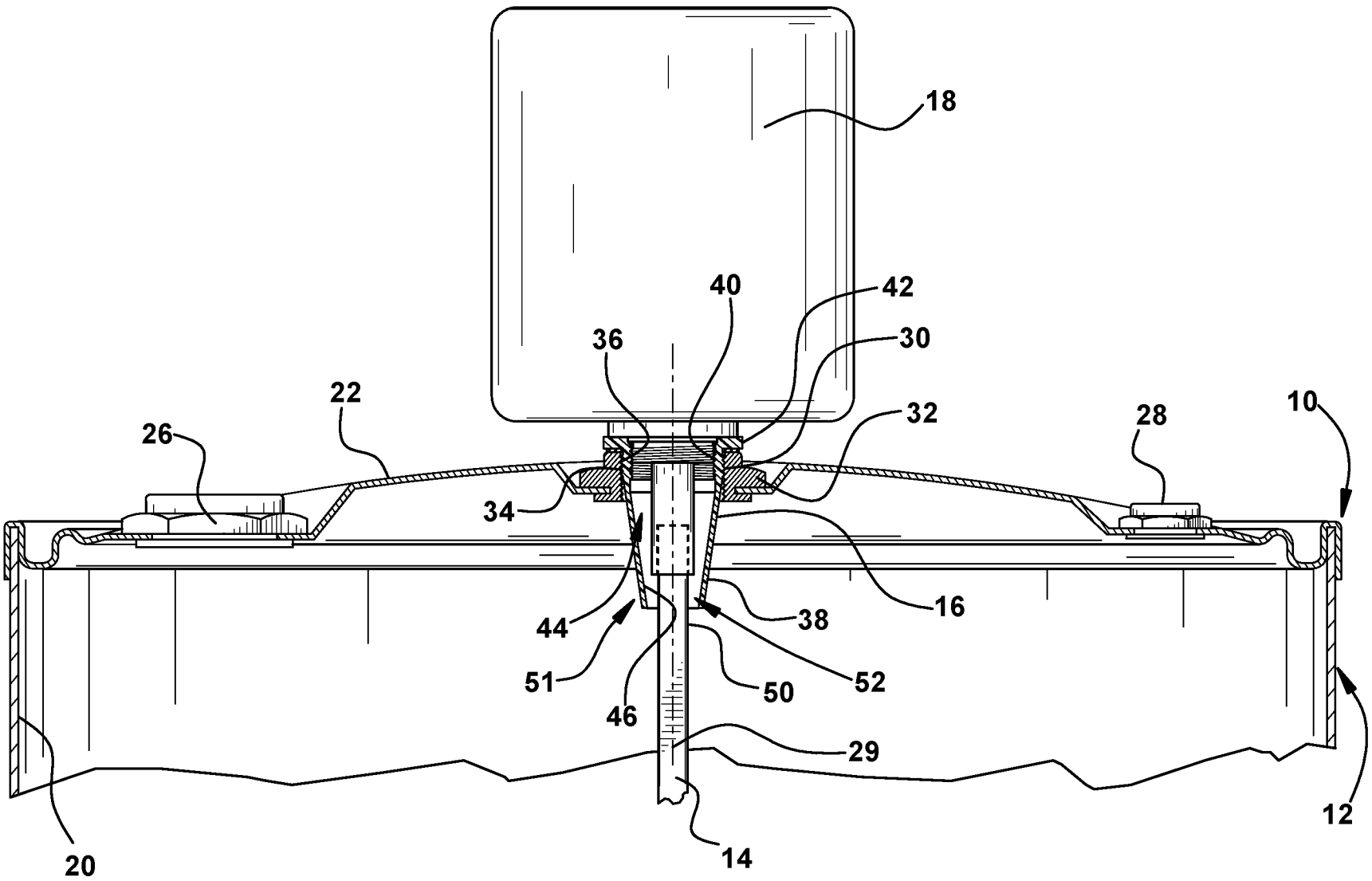
FIG. 2 is an enlarged partial view of the container assembly of FIG. 1, in combination with a powered motive device.

Referring now to the drawings and initially to FIGS. 1 and 2, a container assembly 10 according to the present invention is depicted. The container assembly 10 includes a container, such as a drum 12, an agitator 14 disposed in the drum 12 for agitating fluids located within the drum 12, and an attachment mechanism 16 for supporting the agitator 14 relative to the drum 12.

A motive device 18 is depicted in combination with the container assembly 10 for causing rotation of the agitator 14 relative to the drum 12. The motive device 18 may be any suitable powered or unpowered device for transferring rotational motion of a component of the motive device 18 to the agitator 14. For example, the motive device 18 may include a motor. In other embodiments, the motive device may be a handle that is attachable to the agitator 14 for allowing manual rotation of the agitator 14.

The illustrated drum 12 includes a side wall, such as a cylindrical side wall 20. A circular upper head wall 22 and a circular bottom wall 24 are oppositely disposed at opposite axial sides of the cylindrical side wall 20. The head wall 22 and bottom wall 24 are sized to correspond to a desired drum capacity, such as a fifty gallon, fifty-five gallon, or thirty gallon capacity. The illustrated side wall 20, head wall 22, and bottom wall 24 are composed of sheet metal, such as steel, though other materials such as plastic may be used.

The depicted head wall 22 has a pair of oppositely disposed openings 26 and 28, which may be otherwise located relative to one another in other embodiments. The depicted fill opening 26 and vent opening 28 are disposed at opposite sides of the head wall 22 with the longitudinal drum axis 29 disposed therebetween. A central opening 30 is positioned at the longitudinal drum axis 29 for allowing access to the agitator 14 for causing rotation thereof. The central opening 30 is defined by an annular flange 32 that is attached to the surrounding sheet material of the head wall 22. The annular flange 32 includes internal threads 34 for allowing attachment of the attachment mechanism 16.

Turning now solely to FIG. 2, the attachment mechanism 16 includes corresponding external threads 36 for threadedly coupling to the internal threads 34 of the annular flange 32. The attachment mechanism 16 is thus received in the central opening 30 and through the annular flange 32.

The attachment mechanism 16 is configured to allow for attachment of the motive device 18 thereto, though not all such motive devices may require such attachment. The depicted attachment mechanism 16 includes a body 38 having internal threads 40 at an upper portion thereof that may correspond to threads of a mounting component of the motive device 18. Radially outward of the internal threads 40, the external threads 36 are disposed at an external surface of the body 38. An upper lip 42 is disposed at an upper end of the attachment mechanism 16. The upper lip 42 acts as a stop surface during threading of the external threads 36 to the internal threads 34 of the annular flange 32. The upper lip 42 projects radially outward from a central opening 44 of the attachment mechanism 16.

Via the central opening 44 and conically-shaped inner walls 46 of the body 38, the attachment mechanism 16 is shaped to receive and support a shaft 50 of the agitator 14. When the agitator 14 is placed into the drum 12, and the head wall 22 is connected to the cylindrical side wall 20, the shaft 50 is received into the central opening 30 of the upper head wall 22. A lower or distal end 51 of the attachment mechanism 16, which is disposed internally in the drum 12 after threading coupling of the attachment mechanism 16 to the annular flange 32 and head wall 22, receives at least an upper portion 52 of the shaft 50. The depicted shaft 50 is not coupled directly to the attachment mechanism 16, but rather the conically-shaped inner walls 46 of the body 38 surround and support the upper portion 52 of the shaft 50. In this way, the upper portion 52 of the shaft 50 is precluded from side-to-side (or radial) movement, thereby supporting the agitator 14 for its rotational movement in the drum 12.

Referring again to FIG. 1, when the agitator 14 is not in use, a plug 54 of the attachment mechanism 16 may be received into the central opening 44, which is at least partially defined by the internal threads 40 of the body 38. For example, when the motive device 18 is not threaded to the internal threads 40, the plug 54 may be threaded to the internal threads 40 to seal the central opening 44 of the attachment mechanism 16 (and to seal the central opening 30 of the head wall 22 of the drum 12) to provide closure for the drum 12. In this way, the agitator 14 may be retained in the drum 12, supported by the distal end 51 of the attachment mechanism 16.

A lower end of the agitator 14 is likewise supported for rotational movement at a lower portion of the drum 12 and precluded from side-to-side or radial movement via a support post of the drum 12. Opposite the central opening 30, a support post, such as a pivot pin 56 is coupled to the bottom wall 24, such as being welded along the central longitudinal drum axis 29. The agitator 14, and in particular an impeller 60 of the agitator 14, is mounted on the pivot pin 56 for supporting and aligning the agitator 14 in the drum 12. A pivot bearing 62 is depicted disposed about the pivot pin 56 and being received into the impeller 60 to allow for ease of rotation of the agitator 14, though the bearing 62 may be omitted in other embodiments.

Turning now to FIGS. 3 through 8 showing various views of the agitator 14, as mentioned above, the agitator 14 includes both a shaft 50 and an impeller 60. The agitator 14 may be sized for being disposed in a container having an internal volume in the range of about 10 gallons to about 100 gallons, and more particularly in the range of about 30 gallons to about 60 gallons, and even more particularly in the range of about 50 gallons to about 55 gallons. For example, the agitator 14 may have a length, along a direction of a longitudinal axis of an internal cavity of a suitable container 12, that is about equal to or less than a longitudinal height of the internal cavity of a container having the suitable internal volume. Generally, the agitator 14 extends longitudinally between the head wall 22 and the bottom wall 24 of a container 12 having the suitable internal volume such that the agitator length is not greater than the height of the internal cavity. Additionally, the agitator impeller 60 may have an overall length, in a direction orthogonal to the height direction, that is about equal to or less than a diameter of the internal cavity of the suitable internal volume.

Turning now to the elements of the agitator 14, the shaft 50 is aligned in the drum 12 to extend axially along the longitudinal drum axis 29. The depicted shaft 50 is solid and has a quadrilateral cross-section, such as a square cross-section. In other embodiments, the shaft 50 may be of any suitable shape, and may be solid, partially hollow, or hollow along its full axial length. A typical material from which the shaft 50 is made is steel, although alternative materials also may be suitable.

The impeller 60 has an impeller body 70 that is defined by a hub portion 72 and a plurality of blades 74 extending radially outwardly from a longitudinal hub axis 76 of the hub portion 72. The longitudinal hub axis 76 and the longitudinal drum axis 29 are co-axial with one another when the agitator 14 is aligned in the drum 12 via the attachment mechanism 16 and the pivot pin 56.

The shape of the impeller body 70 is configured with numerous ribs or projections for providing support and structural stability of the impeller body 70 while allowing for reduced material weight and part thicknesses. Such ribs are present at each of the hub portion 72 and blades 74. Although a particular arrangement of ribs is depicted, alternative arrangements, shapes, sizes, dimensions, and angles of projection of said ribs may be suitable in other embodiments.

Figure 3:
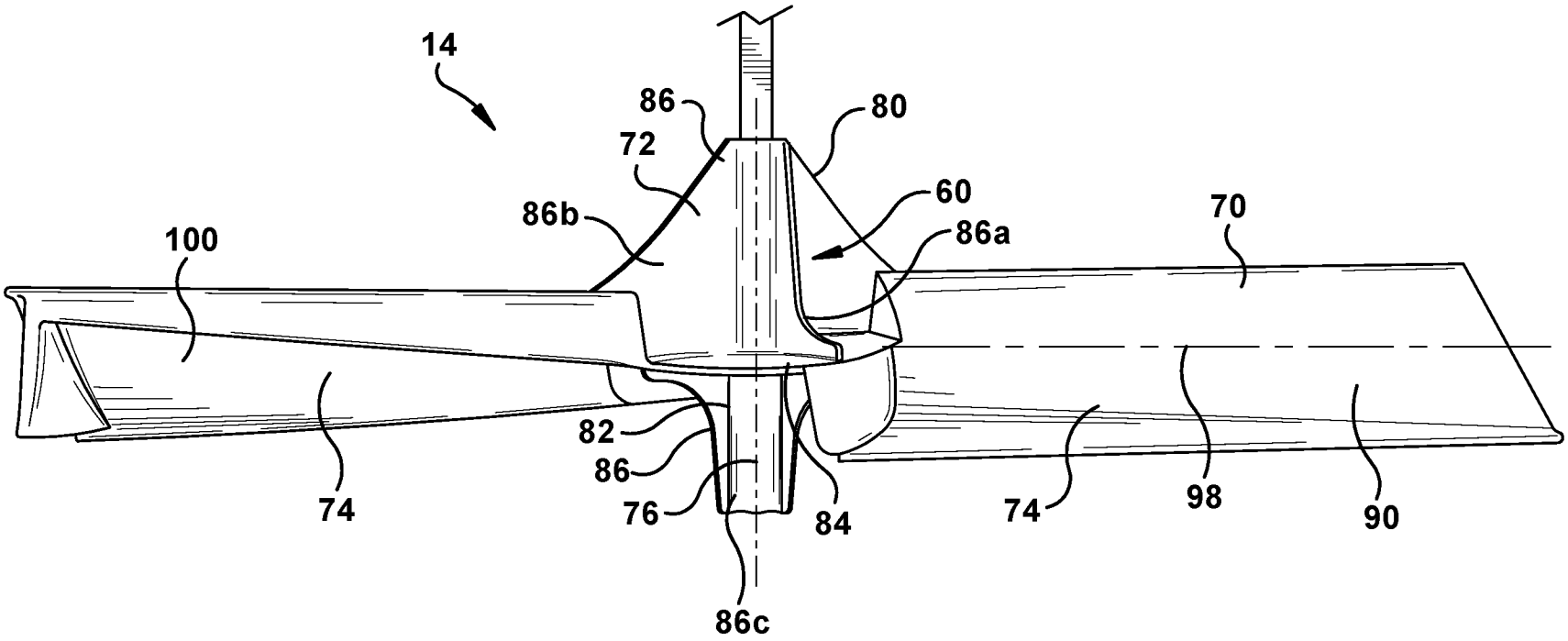
FIG. 3 is an elevated side view of the agitator of FIG. 1.

Referring particularly to FIG. 3, hub portion 72 includes an upper section 80 and a lower section 82 disposed opposite one another and separated from one another by a support projection 84. The support projection 84 extends radially outwardly from the longitudinal hub axis 76. Each of the upper and lower sections 80 and 82 include four circumferentially spaced apart ribs 86 (86*a*, 86*b*, and 86*c*) extending radially outwardly from the longitudinal hub axis 76 and continuing outwardly. A first pair of oppositely disposed ribs 86*a* of the upper section 80 extend to the periphery of the projection 84. A second pair of oppositely disposed ribs 86*b* of the upper section 80 are disposed between the first pair of oppositely disposed ribs 86*a* and extend outwardly to an upper edge of an adjacent blade 74. The ribs 86*c* of the lower section 82 extend outwardly to the periphery of a bottom surface of the projection 84, which bottom surface culminates at an adjacent trailing surface 100 of an adjacent blade 74. The ribs 86*a*, 86*b* and 86*c* provide for axial support of the hub portion 72.

The illustrated ribs 86 are equally circumferentially spaced apart, though other spacing may be suitable. While the depicted upper ribs 86*a* and 86*b* and lower ribs 86*c* are circumferentially aligned with one another about the longitudinal hub axis 76 with equivalent spacing above and below the projection 84, other relative arrangements may be suitable. Upper and lower designations are defined with respect to the positioning of the agitator 14 in an upright drum 12, as shown in FIG. 1.

Figure 4:
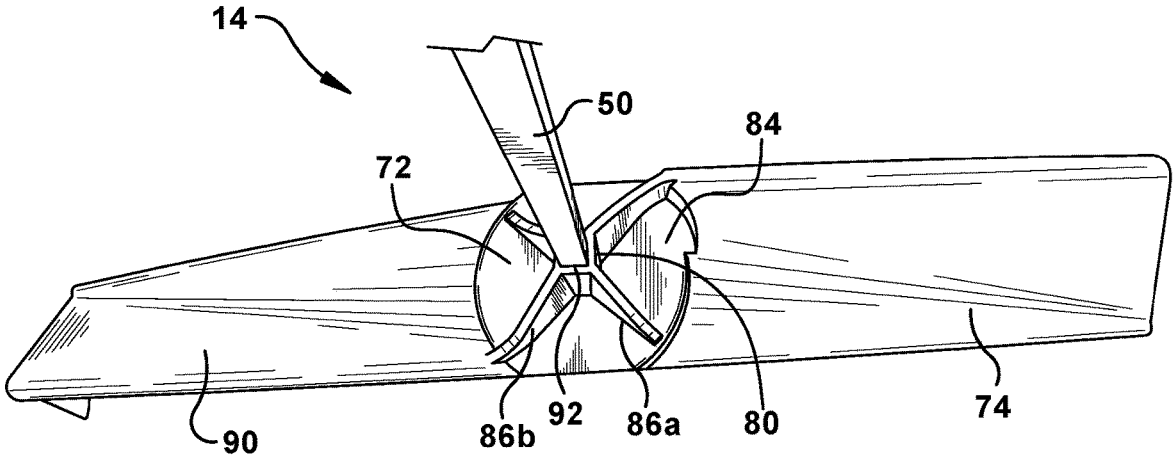
FIG. 4 is an elevated top view of the agitator of FIG. 1.
Figure 5:
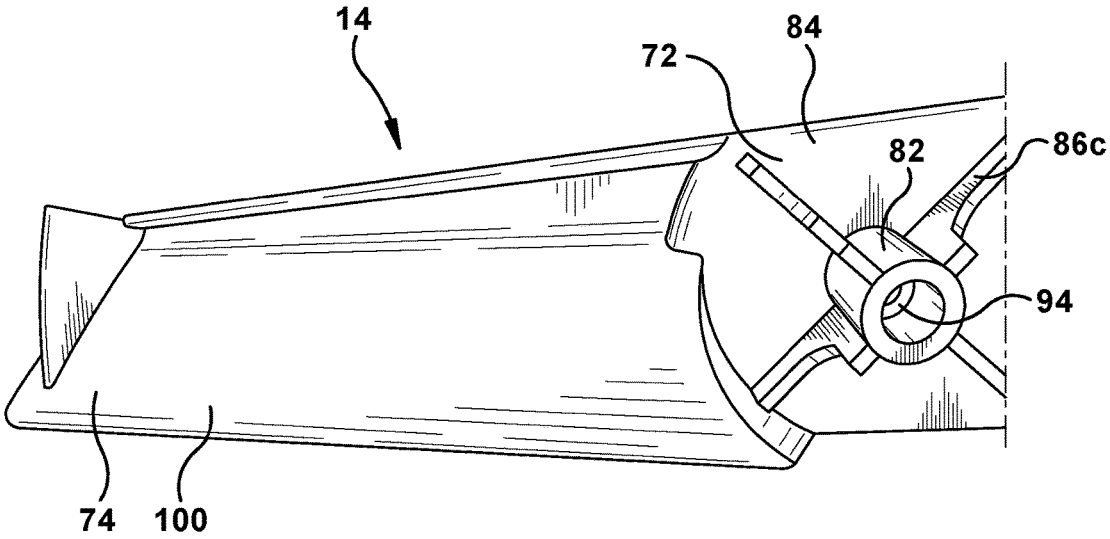
FIG. 5 is an elevated bottom view of the agitator of FIG. 1.

Referring now in particularly to FIGS. 4 and 5, the upper section 80 includes a cavity or recess 92 for receiving a lower end of the shaft 50. The shaft 50 and impeller body 70 may be coupled to one another by any suitable means precluding the shaft 50 from axial removal from the impeller 60. The coupling means may be a tolerance fit, attachment while cooling of the impeller material causing shrinkage about the shaft, welding, adhesive, fastener(s), etc. The lower section 82 also includes a recess 94, opening in an opposite direction as the recess 92. The lower recess 94 is shaped to receive at least the pivot pin 56, and in the depicted embodiment, also to receive the pivot bearing 62. Each of the recesses 92 and 94 are aligned along the longitudinal hub axis 76 (FIG. 3).

Figure 6:
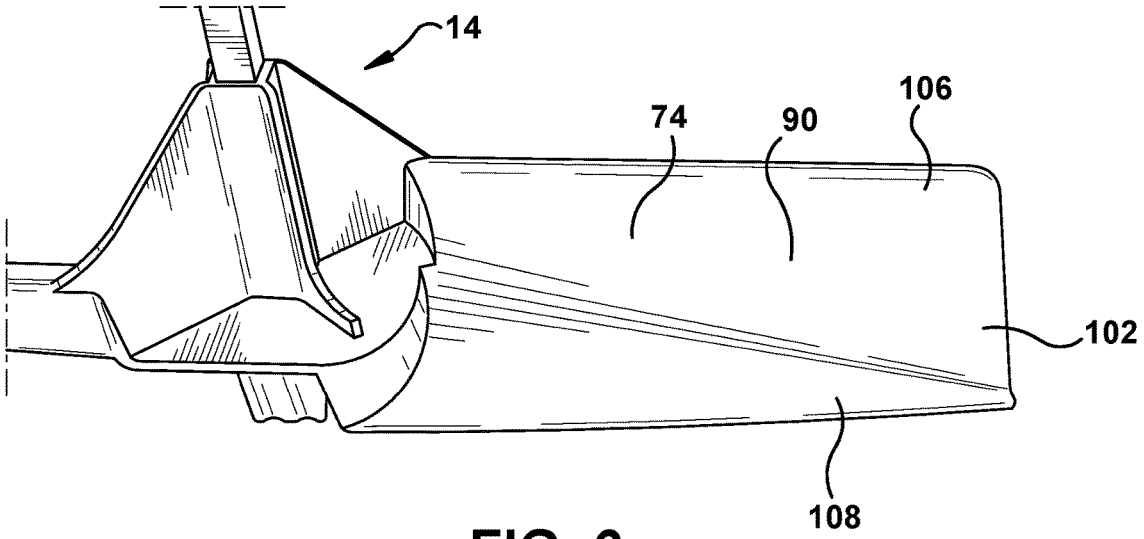
FIG. 6 is a perspective view of the agitator of FIG. 1, taken from the top.
Figure 7:
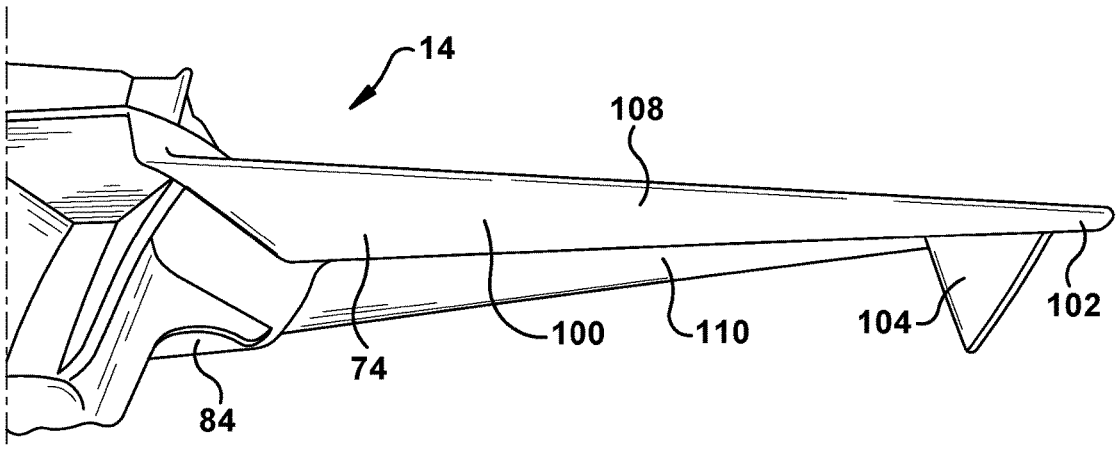
FIG. 7 is a partial perspective view of the agitator of FIG. 1, taken from the bottom.
Figure 8:
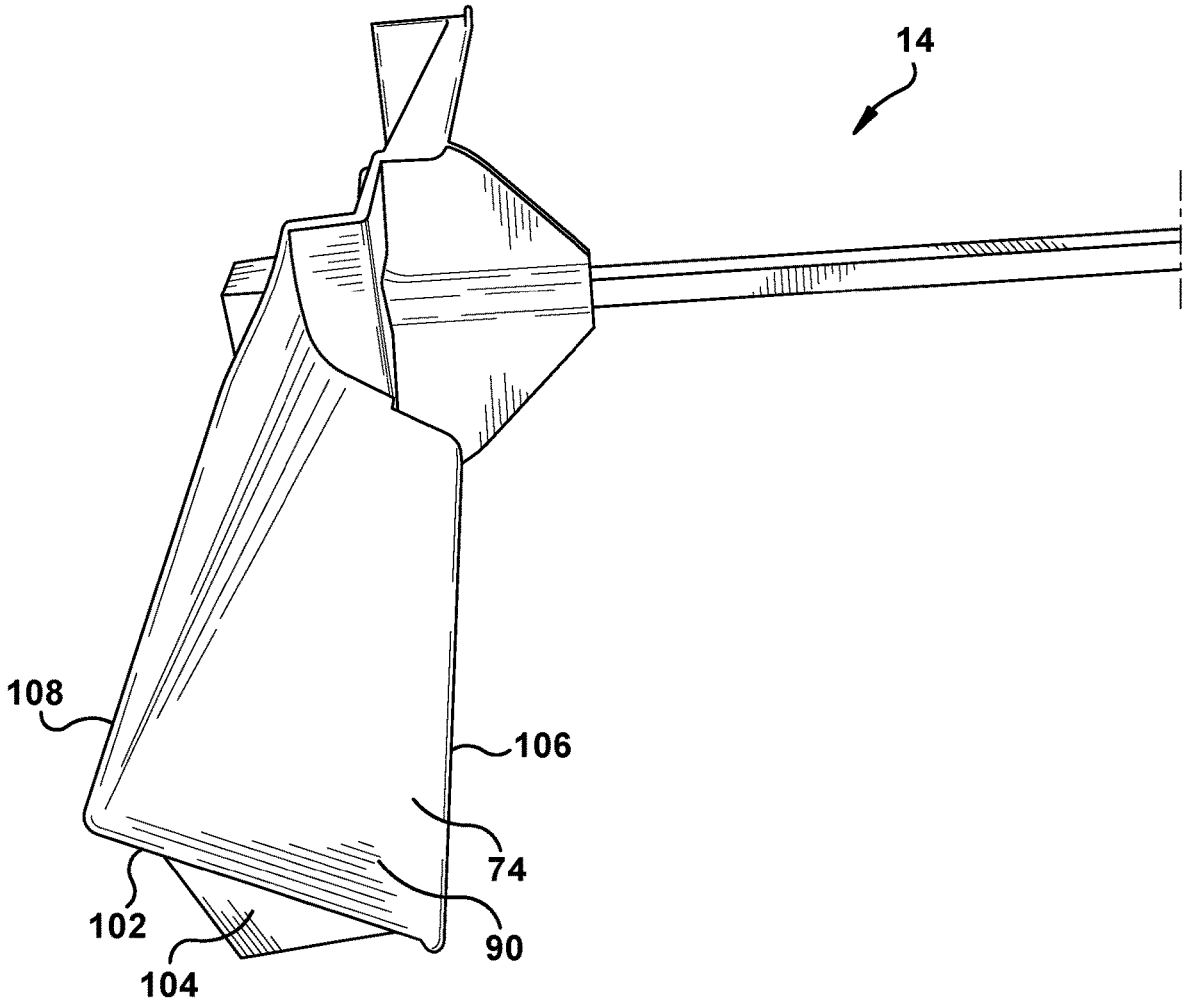
FIG. 8 is a perspective view of the agitator of FIG. 1 taken from the side.

Turning next in particular to FIG. 3 and also FIGS. 6 to 8, the depicted impeller 60 includes a pair of opposed blades 74 extending outwardly from the hub portion 72 in opposite directions along a lateral blade axis 98 (FIG. 3). The shape of the blades 74 is configured for imparting an upward movement of fluid in the drum 12 towards the head wall 22 to adequately agitate the full volume of fluid in the drum 12. Each of the depicted blades 74 is of identical shape and configuration, though alternate configurations may be suitable for imparting the upward movement of fluid in the drum 12.

Each blade 74 has a main blade body having the leading face 90 and a trailing face 100 disposed opposite the trailing face 100. The agitator 14 is rotated such that the leading face 90 is pushed against the fluid in the drum 12. The leading face 90 is upwardly sloped to impart the upward movement of the fluid in the container and may include any suitable slope therefor.

Each of the blades 74 extends along the lateral blade axis 98 towards a distal end 102. The distal ends 102 lie along a circular plane defining a swept diameter of the impeller 60. The swept diameter is generally equal to or less than a diameter of the internal cavity of the drum 12.

Each blade 74 includes one or more ribs, and particularly two or more ribs projecting outwardly from a main blade body and extending along the main blade body in at least two directions transverse one another. With respect to the illustrated blades 74, a transversely-extending rib 104 is located at each respective distal end 102 extending in a direction transverse the lateral blade axis 98. For example, the depicted transversely-extending ribs 104 extend orthogonally to the lateral blade axis 98.

Additionally, each blade 74 includes an upper longitudinal edge 106 and a lower longitudinal edge 108, where a laterally-extending rib 110 extends along each upper longitudinal edge 106. The laterally-extending ribs 110 extend distally towards the lower section 82 of the hub portion 72 from the trailing face 100 of the respective blade 74. The laterally-extending ribs 110 extend along the full lateral length of the respective blades 74 between and joining with each of the projection 84 and the respective transversely-extending rib 104.

The impeller 60 defined by the hub portion 72 and the plurality of blades 74 is a single piece of unitary construction. The impeller body 70 is formed as a single piece without the need for subsequent attachment of the plurality of blades 74 to the hub portion 72. In this way, the plurality of blades 74 extend from the hub portion 74 absent the need for welds or fasteners, for example. Thus, the impeller 60 is a single, whole section, not including joined parts.

Rather, the plurality of blades 72 are formed in a manner that the blades 74 are integral with the hub portion 72 at the formation of the blades 74. In one embodiment, the impeller 60 is a molded article having unitary construction, in that it is formed as a single piece. For example, the one-piece part can be made preferably of a single material, e.g., a synthetic polymer such as nylon, with a molding process, such as an injection molding process. It is noted that a non-steel material of the impeller 60 reduces metal-to metal contact during agitation, as compared to typical use of a steel-bladed agitator in a steel drum.

Other molding processes also may be suitable. Alternative suitable manufacturing processes may include additive manufacturing or electrical discharge machining. Likewise, other materials may be suitable in other embodiments.

In summary, an agitator 14 for being disposed in a container 12 and rotated to agitate fluid in the container 12 includes a shaft 50 and an impeller 60 attached thereto. The shaft 50, being supported relative to the container 12, provides an input for attachment of a rotation mechanism for causing rotation of the impeller 60 and shaft 50. The impeller 60 includes an impeller body 70 defined by a hub portion 72 for receiving and being mounted to the shaft 50, and a plurality of blades 74 extending radially outwardly from a longitudinal axis 76 of the hub portion 72. The impeller body 70 is a single piece of unitary construction, such as where the plurality of blades 74 are formed in a manner that the blades 74 are integral with the hub portion 72 at the formation of the blades 74.

The present invention also includes a method of forming an agitator for agitating a liquid in a container, such as the agitator 14 of FIG. 1. The method includes the step of (a) forming a single article impeller 60 including a central hub portion 72 and two or more blades 74 extending therefrom, wherein the plurality of blades 74 of the impeller 60 are formed in a manner that the blades 74 are integral with the hub portion 72 at the formation of the blades 74. The method also includes the steps of (b) inserting a shaft 50 into an upper receiving cavity 92 of the central hub portion 72, and (c) connecting the shaft 50 to the impeller 60 such that the shaft 50 is precluded from axial removal from the impeller 60. The method may include wherein the forming step (a) is completed absent the need for a secondary operation to attach the blades to the hub portion. The method alternatively or additionally may include wherein the forming step (a) includes molding the impeller 60, such as by injection molding.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

All ranges and ratio limits disclosed in the specification and claims may be combined in any manner. It is to be understood that unless specifically stated otherwise, references to "a," "an," and/or "the" may include one or more than one, and that reference to an item in the singular may also include the item in the plural.

The phrase "and/or" should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

The word "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," may refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

The phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The transitional words or phrases, such as "comprising," "including," "carrying," "having," "containing," "involving," "holding," and the like, are to be understood to be open-ended, i.e., to mean including but not limited to.

What is claimed is:

1. An agitator for being disposed in a container and rotated to agitate a fluid in the container, the agitator comprising:

an impeller having an impeller body comprising:

a hub portion comprising a recess aligned along a longitudinal axis, the recess having an open end and one or more walls that extend along the longitudinal axis and define an interior volume, and a plurality of blades extending radially outwardly from the longitudinal axis of the hub portion, wherein each of the blades includes an upper longitudinal edge opposite a lower longitudinal edge, and wherein a laterally-extending rib extends along the upper longitudinal edge;

wherein the impeller body comprises a single molded article of a polymer material having unitary construction; and a metal shaft for supporting the impeller relative to the container, the metal shaft extending in an axial direction and comprising a lower end that is disposed in and surrounded by the recess of the hub portion, wherein a cross-sectional shape of the lower end of the metal shaft as viewed along the axial direction corresponds to a cross-sectional shape of the recess as viewed along the longitudinal axis, and the lower end of the metal shaft is retained in the recess by contact with the one or more walls of the recess, and the contact precludes axial removal from the impeller.

2. The agitator of claim 1, wherein the hub portion includes an axially extending bottom recess for receiving a support post of a bottom wall of the container.

3. The agitator of claim 1, wherein the plurality of blades includes a pair of opposed blades extending outwardly from the longitudinal axis of the hub portion in opposite directions.

4. The agitator of claim 1, wherein each of the blades extends along a lateral blade axis outwardly from the hub portion to a distal end, and wherein each of the blades includes a transversely-extending rib at the respective distal end extending in a direction transverse the lateral blade axis and transverse the longitudinal axis.

5. The agitator of claim 1, wherein the plurality of blades extend from the hub portion absent the need for welds or fasteners.

6. The agitator of claim 1, wherein the impeller body is formed as a single piece without the need for subsequent attachment of the plurality of blades to the hub portion.

7. The agitator of claim 1, wherein the polymer material includes nylon.

8. The agitator of claim 1, wherein the agitator is sized for being disposed in a container having an internal volume in the range of 10 gallons to 100 gallons.

9. The agitator of claim 1, wherein the agitator is sized for being disposed in a container having an internal volume in the range of 30 gallons to 60 gallons.

10. The agitator of claim 1, wherein the plurality of blades of the impeller body are formed in a manner that the blades are integral with the hub portion at the formation of the blades.

11. The agitator of claim 1, in combination with a container, the impeller body being disposed in the container at a lower portion thereof and the shaft being supported along a central longitudinal axis of the container.

12. A container assembly for containing and agitating a fluid, the container assembly comprising:

a cylindrical container and the agitator of claim 1 disposed in the container for agitating fluid in the container, wherein the container includes a top wall having a central opening for allowing access to the shaft for providing rotation of the agitator within the container.

13. The container assembly of claim 12, wherein the container is a cylindrical drum having an internal volume in the range of 30 gallons to 60 gallons.

14. The container assembly of claim 12, wherein the blades of the pair of blades project from the hub portion absent the need for welds or fasteners in contact with the pair of blades.

15. The container assembly of claim 12, wherein each blade of the pair of blades includes ribs projecting outwardly from a main blade body and extending along the main blade body in at least two directions transverse one another.

16. The agitator of claim 1, wherein the hub portion further comprises:

a support projection extending radially outwardly from the longitudinal hub axis; and an upper section extending from the support projection along the longitudinal hub axis, wherein the recess is included as part of the upper section.

17. The agitator of claim 16, wherein the upper section comprises ribs that extend outwardly to a periphery of the support projection of the hub portion.

18. The agitator of claim 1, wherein the lower end of the metal shaft is retained in the recess only by the contact with the one or more walls of the recess.

19. The agitator of claim 1, wherein the contact of the metal shaft with the one or more walls of the recess is from shrinkage of the recess on the lower end of the shaft upon cooling of the molded impeller with the lower end of the metal shaft disposed in the recess.

* * * * *